US011591058B2

(12) United States Patent
Kimpara

(10) Patent No.: US 11,591,058 B2
(45) Date of Patent: Feb. 28, 2023

(54) SHIP PROPULSION MACHINE

(71) Applicant: SUZUKI MOTOR CORPORATION, Hamamatsu (JP)

(72) Inventor: Masatoshi Kimpara, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 78 days.

(21) Appl. No.: 17/226,585

(22) Filed: Apr. 9, 2021

(65) Prior Publication Data

US 2021/0316833 A1 Oct. 14, 2021

(30) Foreign Application Priority Data

Apr. 14, 2020 (JP) ..... JP2020-072402

(51) Int. Cl.
*B63H 20/28* (2006.01)
*F01P 3/20* (2006.01)
*F02B 61/04* (2006.01)

(52) U.S. Cl.
CPC ..... *B63H 20/28* (2013.01); *F01P 3/202* (2013.01); *F02B 61/045* (2013.01)

(58) Field of Classification Search
CPC ..... B63H 20/28; F01P 3/202; F02B 61/045
See application file for complete search history.

(56) References Cited

U.S. PATENT DOCUMENTS 5,049,101 A * 9/1991 Binversie ..... F01P 3/205 440/88 N
2001/0036778 A1* 11/2001 Takayanagi ..... F02M 69/462 440/88 P
2002/0182949 A1* 12/2002 Tanaka ..... B63H 21/383 440/88 M

FOREIGN PATENT DOCUMENTS

JP 61-184198 A 8/1986
KR 20110012649 A * 9/2011 ..... B01D 46/0005

* cited by examiner

*Primary Examiner* — Stephen P Avila
(74) *Attorney, Agent, or Firm* — Stein IP, LLC

(57) ABSTRACT

There is provided a ship propulsion machine that gives a propulsive force to a ship, including: a power source; a propulsion device that converts power of the power source into a propulsive force of the ship; a power transmission mechanism that transmits power of the power source to the propulsion device; a casing that covers the power source and the power transmission mechanism; and a fine dust capturing device. The fine dust capturing device includes: a water intake which is provided in the casing and through which water around the ship propulsion machine is to be taken in, a capturer that captures fine dust contained in water taken in from the water intake, and a water outlet through which water in which the fine dust was captured by the capturer is to be discharged.

7 Claims, 6 Drawing Sheets

[Fig. 1]
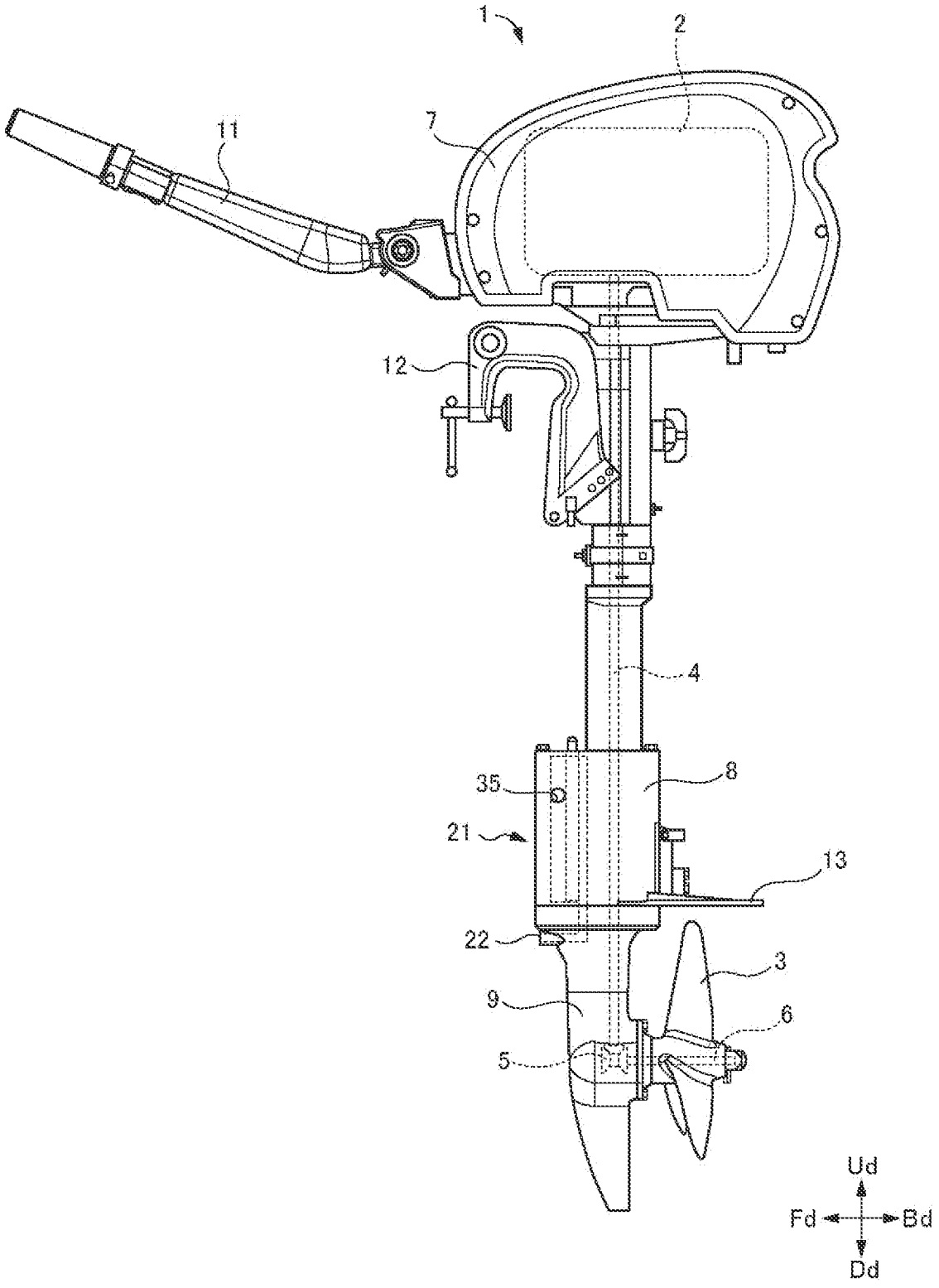

[Fig. 2]
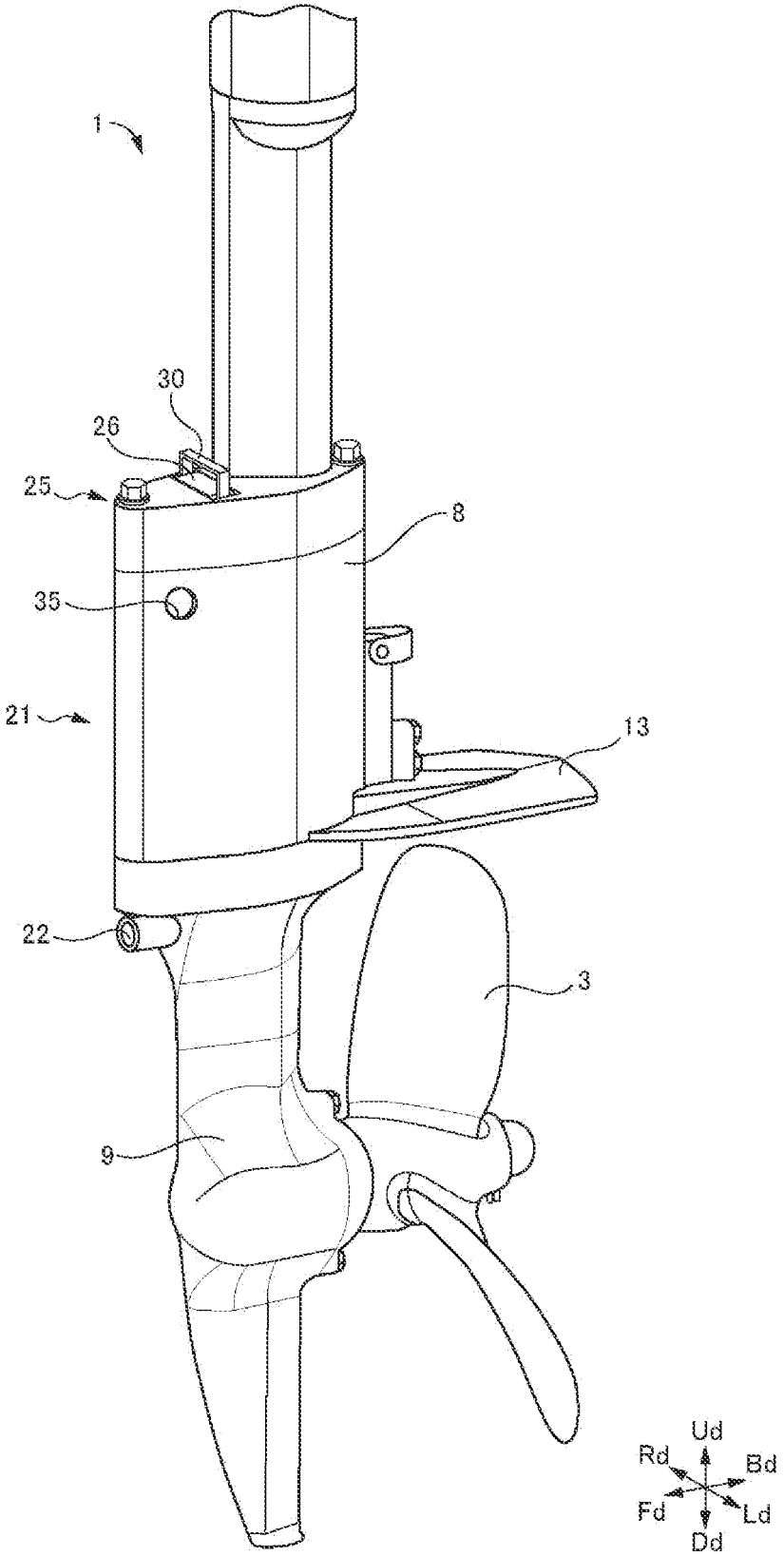

[Fig. 3]
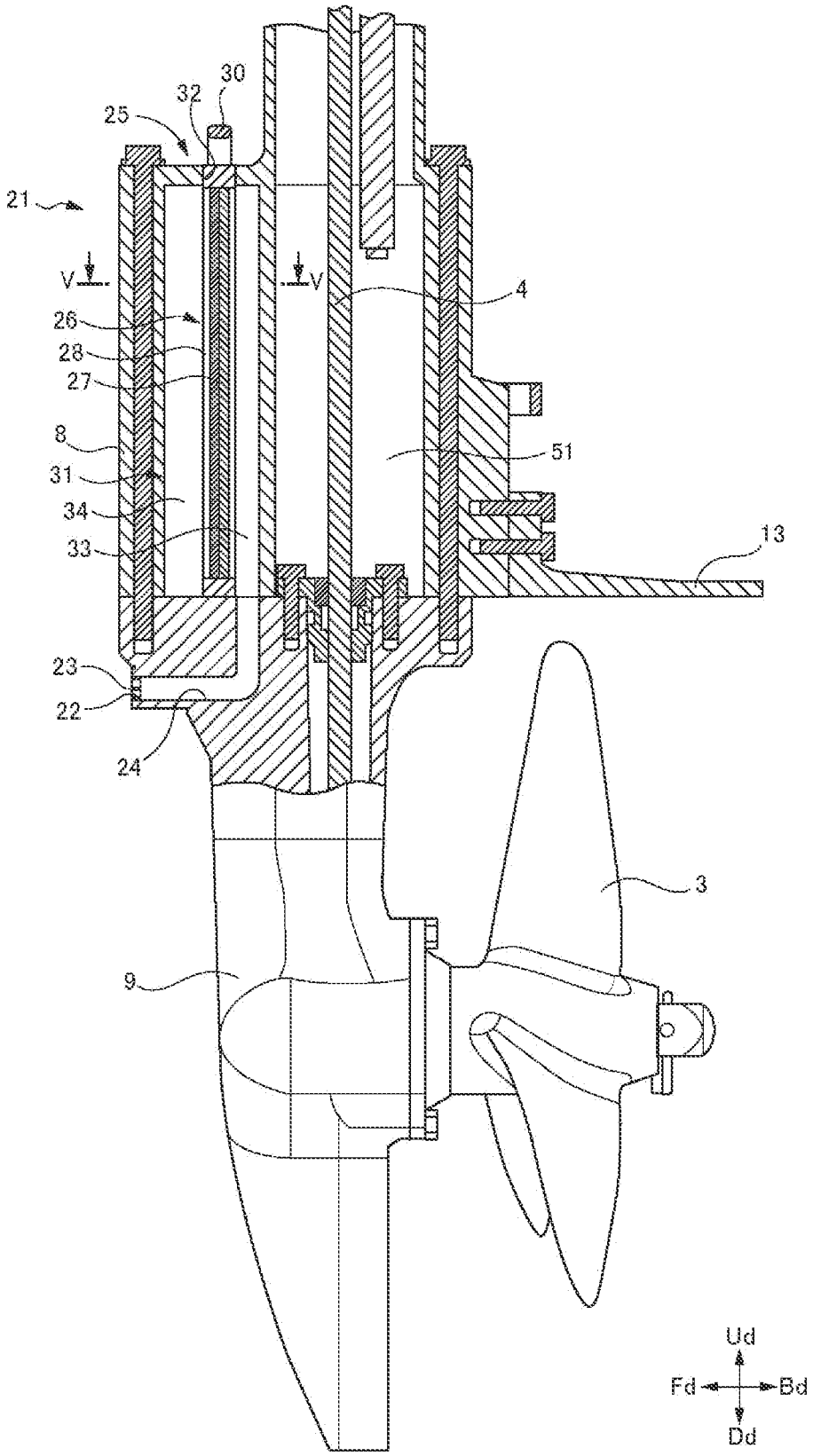

[Fig. 4]
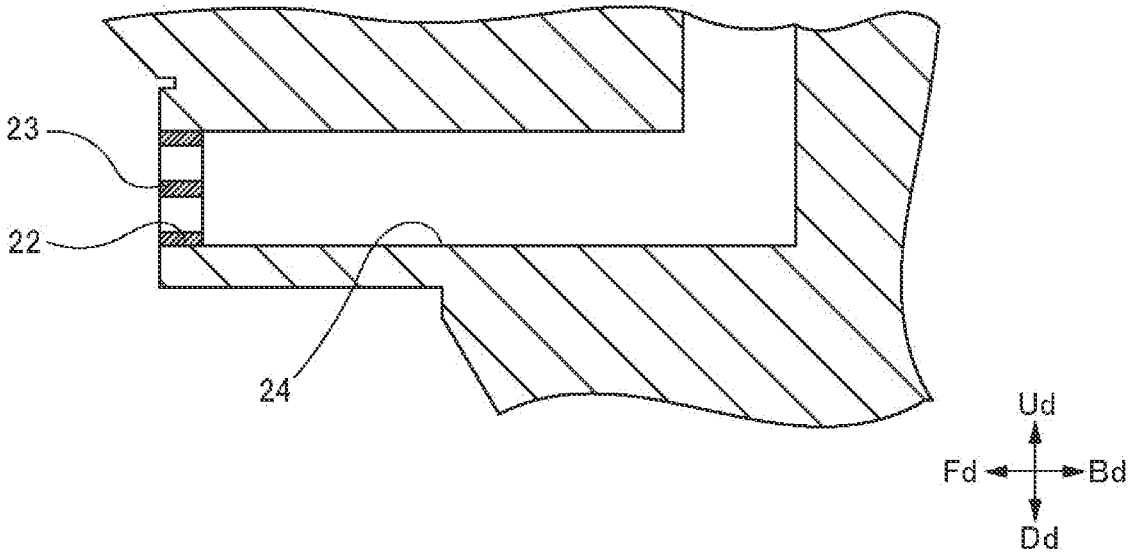
[Fig. 5]
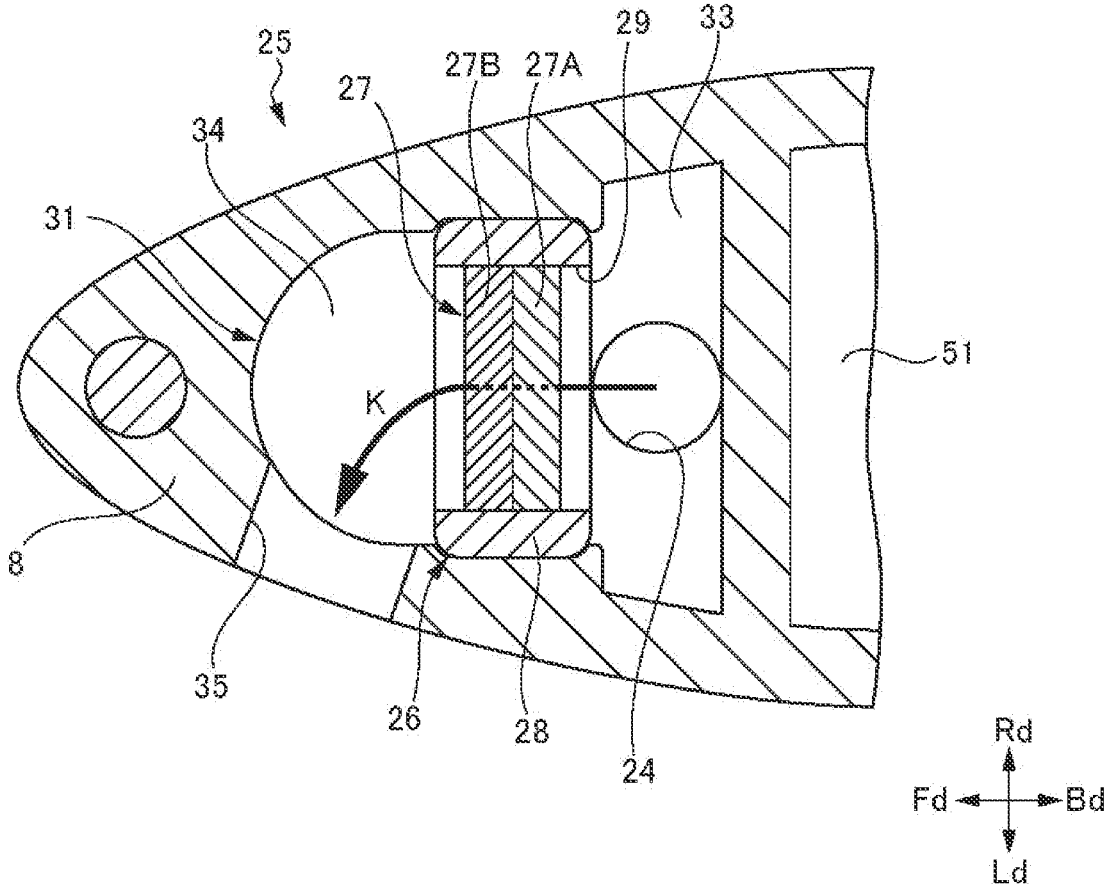

[Fig. 6]
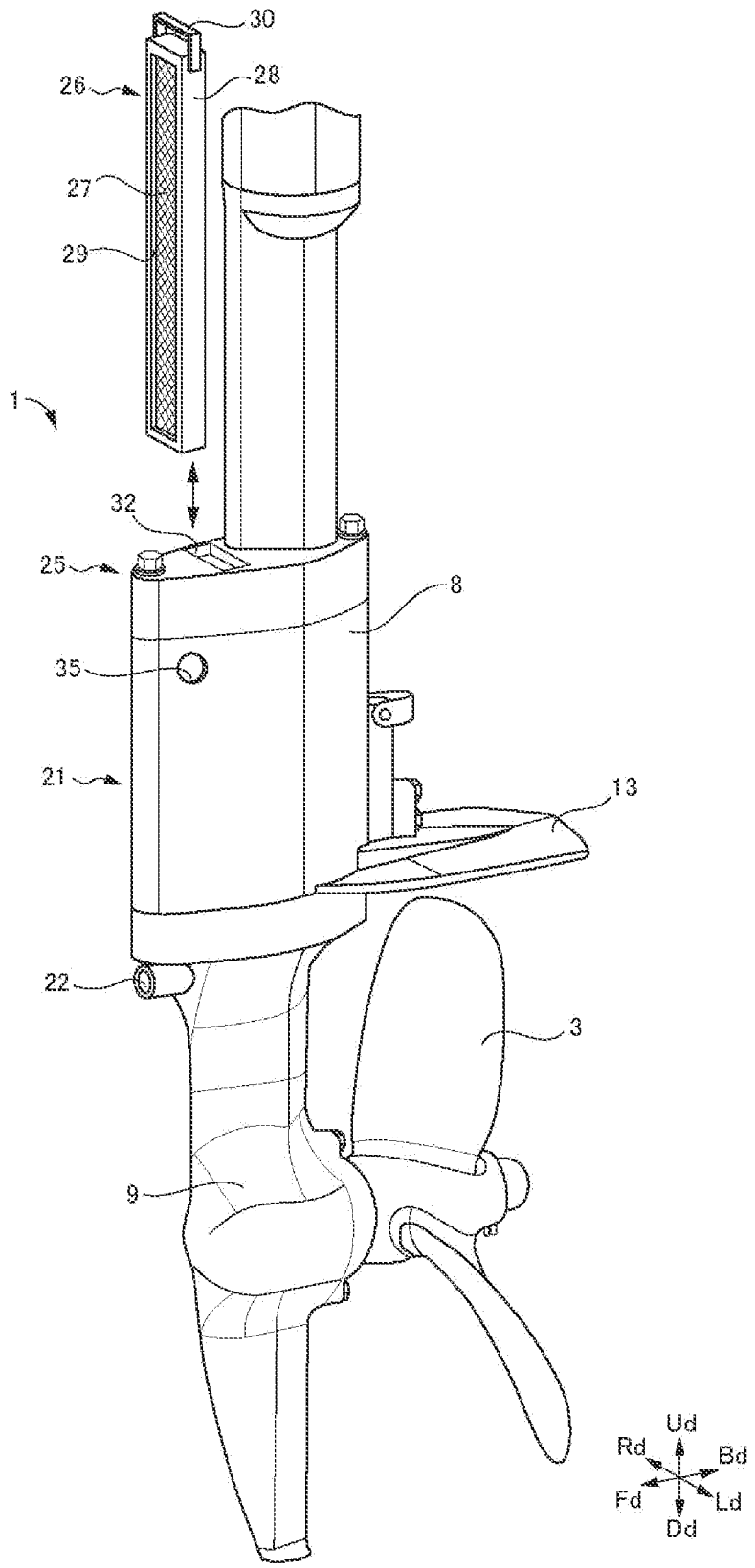

[Fig. 7]
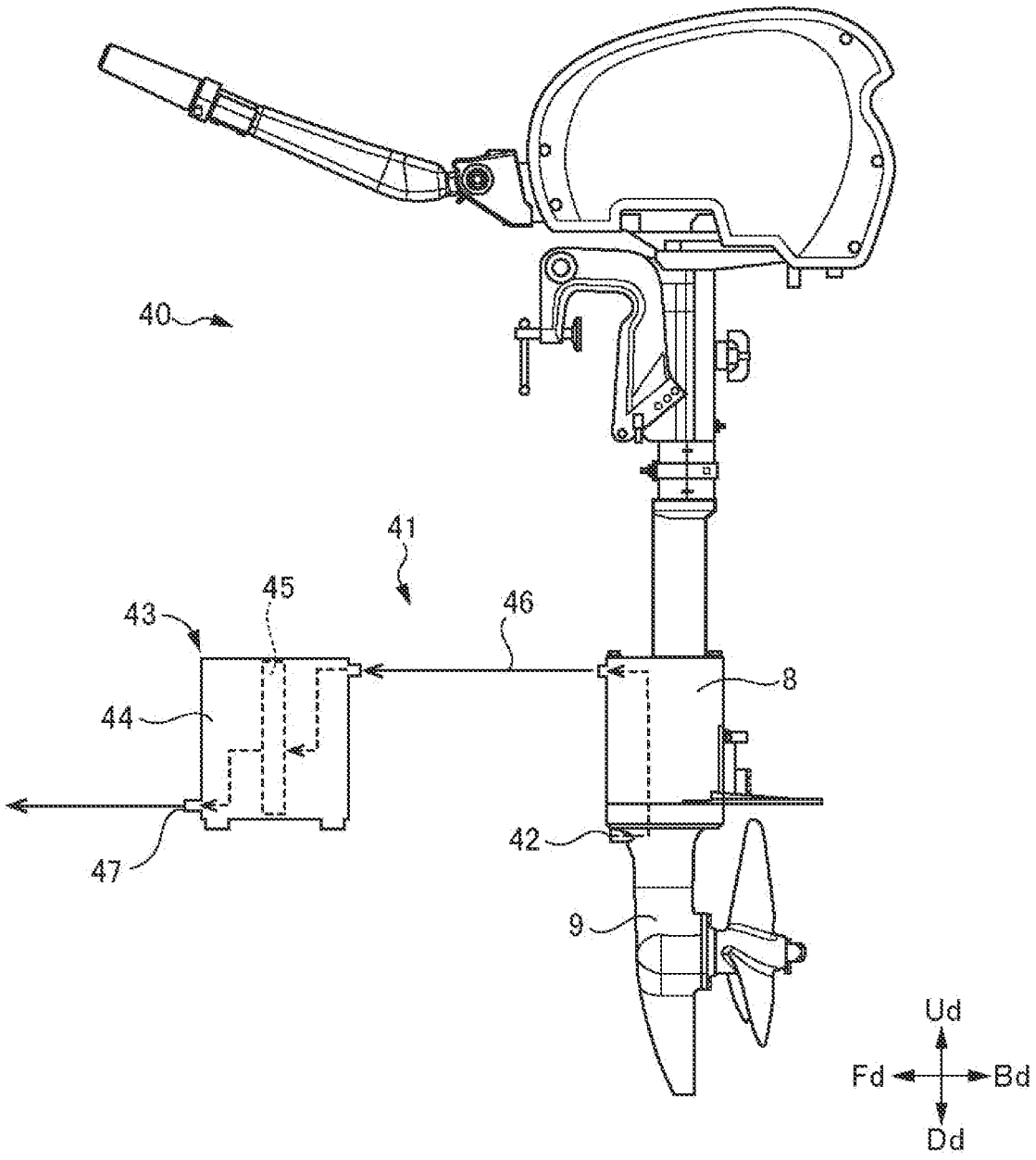

SHIP PROPULSION MACHINE

CROSS-REFERENCE TO RELATED APPLICATIONS

This application is based on Japanese Patent Application No. 2020-072402 filed on Apr. 14, 2020, the contents of which are incorporated herein by way of reference.

TECHNICAL FIELD

The present invention relates to a ship propulsion machine such as an outboard motor or an inboard/outboard motor.

BACKGROUND

Examples of a ship propulsion machine that gives a propulsive force to a ship include an outboard motor, an inboard/outboard motor, and the like. The following Patent Literature 1 describes an example of the ship propulsion machine.

Patent Literature 1: JP-A-S61-184198

In recent years, for example, pollution caused by fine dust such as microplastics has become a problem in such as sea, lakes, and rivers, and it is desired to retrieve the fine dust from such as the sea, lakes, and rivers. Although definition of the microplastics is not determined, generally, particulate plastics with an outer diameter or maximum length of 5 mm or less are often called microplastics. Therefore, here, dust having an outer diameter or maximum length of 5 mm or less is referred to as fine dust. It is not easy to retrieve the fine dust because the fine dust is very small and is diffused over a wide area such as the sea, lakes, and rivers.

In order to solve the problem of pollution caused by the fine dust in such as the sea, lakes, and rivers, the inventor of this application has devised use of the ship propulsion machine for retrieving the fine dust. By using the ship propulsion machine for retrieving the fine dust, the fine dust can be retrieved during an operation of the ship provided with the ship propulsion machine. Further, since the ship are operated everywhere in such as the sea, lakes, rivers, by using the ship propulsion machine to retrieve the fine dust, retrieving the fine dust diffused in the wide area such as the sea, lakes, and rivers can be promoted.

However, at present, there is no known ship propulsion machine having a function of retrieving fine dust.

As described in Patent Literature 1, the ship propulsion machine may be provided with a mechanism for cooling a cylinder block of an engine by taking water from such as the sea, lakes, and rivers as cooling water into the ship propulsion machine and making the water flow through a cooling water channel formed in the cylinder block. In order to prevent dust such as seaweed, or PET bottle lids from being taken into the ship propulsion machine together with water when the water from such as the sea, lakes, and rivers is taken into the ship propulsion machine, such a cooling mechanism may be provided with a strainer at a water intake and the like. The dust such as seaweed and PET bottle lids can be retrieved by the strainer. However, fine dust that is significantly smaller than seaweed and PET bottle lids cannot be retrieved by the strainer. In a ship propulsion machine provided with such a cooling mechanism, even when the fine dust is taken into the ship propulsion machine together with water from such as the sea, lakes, and rivers, the fine dust flows through the cooling water channel together with water and then is discharged from the ship propulsion machine to the sea, lakes, rivers, and the like.

Further, in a ship propulsion machine provided with such a cooling mechanism, a method is conceivable in which a fine filter is provided at the water intake and the fine dust is retrieved by the filter. However, when the fine filter is provided at the water intake, the filter is a resistance, so that the water to be used as the cooling water cannot be sufficiently taken into the ship propulsion machine, and the engine cooling performance of the cooling mechanism decreases.

The present invention has been made in view of, for example, the above problems, and an object of the present invention is to provide a ship propulsion machine which can retrieve fine dust.

SUMMARY

In order to solve the above problem, there is provided a ship propulsion machine that gives a propulsive force to a ship, including: a power source; a propulsion device that converts power of the power source into a propulsive force of the ship; a power transmission mechanism that transmits power of the power source to the propulsion device; a casing that covers the power source and the power transmission mechanism; and a fine dust capturing device. The fine dust capturing device includes: a water intake which is provided in the casing and through which water around the ship propulsion machine is to be taken in, a capturer that captures fine dust contained in water taken in from the water intake, and a water outlet through which water in which the fine dust was captured by the capturer is to be discharged.

BRIEF DESCRIPTION OF DRAWINGS

FIG. 1 is an overall view showing an outboard motor according to an embodiment of the present invention.

FIG. 2 is a perspective view showing a state in which a portion of the outboard motor according to the embodiment of the present invention from a center to a bottom in an upper-down direction is viewed from the front upper left.

FIG. 3 is a cross-sectional view showing a state in which the portion of the outboard motor according to the embodiment of the present invention from the center to the bottom in the upper-down direction is cut by a plane passing through an axis of a drive shaft and extending in upper-down and front-back directions, and the cut surface is viewed from the left.

FIG. 4 is an enlarged cross-sectional view showing a water intake of the outboard motor in FIG. 3.

FIG. 5 is a cross-sectional view showing a state in which a fine dust capturing device according to an embodiment of the present invention is cut along a line V-V in FIG. 3 and the cut surface is viewed from above.

FIG. 6 is a perspective view showing a state in which a filter cartridge is separated from a filter accommodating portion of a capturer provided in the outboard motor according to the embodiment of the present invention.

FIG. 7 is a view illustrating a modification of an outboard motor according to the embodiment of the present invention.

DESCRIPTION OF EMBODIMENTS

A ship propulsion machine according to an embodiment of the present invention includes a power source; a propulsion device that converts power of the power source into a propulsive force of a ship; a power transmission mechanism that transmits power of the power source to the propulsion device; a casing that covers the power source and the power transmission mechanism; and a fine dust capturing device. Further, the fine dust capturing device includes a water intake, a capturer; and a water outlet. The water intake is provided in the casing of the ship propulsion machine and is a port for taking in water around the ship propulsion machine. The capturer is a device or appliance that captures fine dust contained in water taken in from the water intake. The water outlet is a port for discharging water in which the fine dust was captured by the capturer.

According to the embodiment of the present invention, the fine dust contained in water of such as the sea, lakes, and rivers can be retrieved by the fine dust capturing device having such a configuration. Since the ship propulsion machine includes the fine dust capturing device, the fine dust can be retrieved during an operation of the ship to which the ship propulsion machine is attached. Therefore, for example, by attaching the ship propulsion machine to ships existing all over the world, the fine dust can be retrieved all over the world and retrieving the fine dust can be promoted.

Further, the water intake, the capturer, and the water outlet provided in the fine dust capturing device according to the present embodiment can be provided in the ship propulsion machine in a form of being independent of a cooling system of the ship propulsion machine for cooling the power source of the ship propulsion machine with water, due to a structure of the water intake, the capturer, and the water outlet. The fine dust capturing device is independent of the cooling system of the ship propulsion machine, and thus the fine dust can be retrieved without decreasing the power source cooling performance of the cooling system of the ship propulsion machine.

Embodiment

An outboard motor 1 that is an embodiment of the ship propulsion machine of the present invention will be described with reference to the drawings. In the present embodiment, front (Fd), back (Bd), upper (Ud), down (Dd), left (Ld), and right (Rd) directions follow arrows drawn at a lower right portion of each drawing.

FIG. 1 shows the entire outboard motor 1. As shown in FIG. 1, the outboard motor 1 includes an internal combustion engine 2 as a power source and a propeller 3, as a propulsion device, which converts power of the internal combustion engine 2 into a propulsive force of a ship. Further, the outboard motor 1 includes, as a power transmission mechanism for transmitting the power of the internal combustion engine 2 to the propeller 3, a drive shaft 4, a gear device 5, and a propeller shaft 6.

The internal combustion engine 2 is provided on an upper part of the outboard motor 1 so as to be disposed above a water surface when the outboard motor 1 is attached to the ship. The propeller 3 is provided on a lower part of the outboard motor 1 so as to be disposed below the water surface when the outboard motor 1 is attached to the ship.

The drive shaft 4 extends in an upper-down direction from the upper part to the lower part of the outboard motor 1. An upper end portion of the drive shaft 4 is connected to the internal combustion engine 2, and the drive shaft 4 is rotated based on the power of the internal combustion engine 2. A lower end portion of the drive shaft 4 is connected to the gear device 5 provided in front of the propeller 3.

The gear device 5 includes a drive gear that rotates together with the drive shaft 4; a forward gear that meshes with the drive gear and transmits rotation of the drive shaft 4 to the propeller shaft 6 during a forward operation, a reverse gear that meshes with the drive gear and transmits rotation of the drive shaft 4 to the propeller shaft 6 during a reverse operation; and a clutch that selects a gear for transmitting the rotation of the drive shaft 4 to the propeller shaft 6 from the forward gear and the reverse gear according to the forward operation and the reverse operation.

The propeller shaft 6 is a rotation shaft of the propeller 3 and extends in a front-back direction. The propeller 3 is fixed to the propeller shaft 6, and a front end portion of the propeller shaft 6 is connected to the gear device 5. The propeller shaft 6 rotates in response to the rotation of the drive shaft 4 transmitted via the forward gear or the reverse gear. The propeller 3 rotates as the propeller shaft 6 rotates.

Further, the outboard motor 1 includes, as a casing for covering the internal combustion engine 2 and the power transmission mechanism, a cowling 7, a shaft casing 8, and a gear casing 9. The cowling 7 is provided on the upper part of the outboard motor 1 and covers the internal combustion engine 2. The shaft casing 8 is provided on an intermediate part of the outboard motor 1 in the upper-down direction and covers the drive shaft 4. The gear casing 9 is provided on the lower part of the outboard motor 1 and covers the gear device 5 and a front part of the propeller shaft 6.

The outboard motor 1 is provided with a tiller bar handle 11 for a ship maneuvering operation, a clamp bracket 12 for fixing the outboard motor 1 to a hull of the ship, and an anti-ventilation plate 13 for preventing air from flowing from the water surface to the propeller 3. The tiller bar handle 11 is disposed in front of the internal combustion engine 2. The clamp bracket 12 is disposed on the upper part of the outboard motor 1 and below the internal combustion engine 2. The anti-ventilation plate 13 is disposed on the lower part of the outboard motor 1 and above the propeller 3.

Further, the outboard motor 1 includes a fine dust capturing device 21 that captures fine dust. In the present embodiment, the fine dust means visible dust having an outer diameter or a maximum length of 5 mm or less. Specifically, the fine dust means dust having an outer diameter or a maximum length of 0.1 mm or more and 5 mm or less. For example, microplastics are fine dust. The fine dust capturing device 21 is disposed at a position slightly below a center of the outboard motor 1 in the upper-down direction. A position of the fine dust capturing device 21 in the upper-down direction is set such that an upper part of the fine dust capturing device 21 is above the water surface and a lower part of the fine dust capturing device 21 sinks below the water surface. The fine dust capturing device 21 is disposed in front of the drive shaft 4. Further, the fine dust capturing device 21 is disposed in a front part of the shaft casing 8.

FIG. 2 shows a state in which the portion of the outboard motor 1 from a center to a bottom in the upper-down direction is viewed from the front upper left. FIG. 3 shows a state in which the portion of the outboard motor 1 from the center to the bottom in the upper-down direction is cut by a plane passing through an axis of the drive shaft 4 and extending in the upper-down and front-back directions, and the cut surface is viewed from the left. FIG. 4 shows an enlarged water intake 22 of the fine dust capturing device 21 in FIG. 3. FIG. 5 shows a state in which the fine dust capturing device 21 is cut along a line V-V in FIG. 3 and the cut surface is viewed from above. FIG. 6 shows a state in which a filter cartridge 26 is separated from a filter accommodating portion 31 of a capturer 25 provided in the outboard motor 1.

As shown in FIGS. 2 and 3, the fine dust capturing device 21 includes the water intake 22, a supply passage 24, the capturer 25, and a water outlet 35.

The water intake 22 is a port for taking in water around the outboard motor 1. The water intake 22 is disposed below the anti-ventilation plate 13. The water intake 22 is formed in an upper part of the gear casing 9. Further, the water intake 22 is disposed in a front part of the gear casing 9 (for example, right in front of the gear casing 9) and is opened forward. In a state in which the outboard motor 1 is attached to the hull, the water intake 22 sinks below the water surface. When the ship moves forward in such as the sea, lakes or rivers, water in the sea, lakes or rivers hits the front part of the shaft casing 8. Then, the water flows into the water intake 22 that is in the front part of the shaft casing 8 and is opened forward.

An inner diameter of the water intake 22 is, for example, about 30 mm. However, when an inflow amount of water into the water intake 22 is small, the inner diameter of the water intake 22 may be made larger. Further, the inner diameter of the water intake 22 can be made smaller, but this is not preferable because it is difficult for the water to flow into the water intake 22 when the inner diameter of the water intake 22 is too small.

As shown in FIG. 4, a strainer 23 is provided in the water intake 22. The strainer 23 has a function of removing objects larger than the fine dust among objects contained in the water to be supplied to the capturer 25 through the water intake 22. As an object larger than the fine dust, for example, seaweed or PET bottle lids floating in the water or on the water surface of the sea, lakes or rivers are considered. For example, the strainer 23 is formed in a disk shape having a diameter equal to the inner diameter of the water intake 22, and is attached inside the water intake 22. Further, a plurality of through holes each having a diameter of, for example, larger than 5 mm and smaller than 15 mm are formed in the strainer 23. Seaweed, PET bottle lids, and the like can be prevented from entering the water intake 22 by the strainer 23. The strainer 23 may be formed by a wire mesh. The water intake 22 may be formed by a collection of a plurality of small holes each having a diameter of larger than 5 mm and smaller than about 15 mm, and in this case, since the water intake 22 itself functions as the strainer, the strainer 23 may not be provided separately. Further, the strainer may be disposed outside the water intake 22, specifically, immediately in front of the water intake 22.

The supply passage 24 is a passage for supplying the water taken in from the water intake 22 to the capturer 25. As shown in FIG. 3, the supply passage 24 is provided in a front-upper part of the gear casing 9. The supply passage 24 connects the water intake 22 and an interior of a first chamber 33 of the filter accommodating portion 31 of the capturer 25. Although the supply passage 24 of the present embodiment is formed by a hole provided in the gear casing 9, the supply passage 24 may be formed by a hose or pipe connecting the water intake 22 and the first chamber 33 of the filter accommodating portion 31.

The capturer 25 is a device for capturing fine dust contained in water taken in from the water intake 22. The capturer 25 is disposed above the anti-ventilation plate 13. The capturer 25 is disposed in front of the drive shaft 4 in the shaft casing 8. The capturer 25 is located above the water intake 22.

The capturer 25 includes the filter cartridge 26 and the filter accommodating portion 31 for accommodating the filter cartridge 26.

The filter cartridge 26 includes a sheet-shaped or plate-shaped filter 27, and a support 28 for supporting the filter 27. As shown in FIG. 6, for example, the support 28 is formed in a rectangular parallelepiped shape that is long in the upper-down direction. The support 28 is provided with a filter mounting portion 29 for mounting the filter 27. That is, a hole that penetrates the support 28 in the front-back direction and that is long in the upper-down direction and is rectangular in front view, is formed in the support 28. The hole is the filter mounting portion 29. A holding portion 30 is provided on an upper part of the support 28.

The filter 27 is a filter capable of capturing fine dust, and is formed of, for example, anon-woven fabric. Further, the filter 27 preferably has a multi-layer structure. The filter 27 of the present embodiment has, for example, a coarse first layer 27A and a fine second layer 27B, as shown in FIG. 5. An arrow K in FIG. 5 indicates a flow direction of water supplied from the water intake 22 through the supply passage 24 into the filter accommodating portion 31 of the capturer 25 and discharged from the filter accommodating portion 31 through the water outlet 35. The first layer 27A is disposed upstream in the water flow direction, and the second layer 27B is disposed downstream in the water flow direction. The filter 27 may have a single layer or three or more layers. Further, the filter 27 may also be formed of a material other than the non-woven fabric, for example, a woven fabric, a sponge, or a glass mat.

As shown in FIG. 3, the filter accommodating portion 31 is provided in the front part of the shaft casing 8. The filter accommodating portion 31 of the present embodiment is integrally formed with the shaft casing 8. Specifically, a drive shaft insertion portion 51 through which the drive shaft 4 is inserted, is formed in a rear part of the shaft casing 8, and the filter accommodating portion 31 is formed in the front part of the shaft casing 8.

Further, as shown in FIG. 6, a cartridge insertion port 32 is provided in an upper part of the filter accommodating portion 31. The cartridge insertion port 32 is formed in an upper wall of the front part of the shaft casing 8 such that the upper wall is penetrated in the upper-down direction, and the cartridge insertion port 32 is in communication with an interior of the filter accommodating portion 31. The filter cartridge 26 is inserted into the cartridge insertion port 32 from above. By inserting the filter cartridge 26 into the filter accommodating portion 31 through the cartridge insertion port 32, as shown in FIGS. 3 and 5, the interior of the filter accommodating portion 31 is divided into the first chamber 33 located upstream of the filter 27 and a second chamber 34 located downstream of the filter 27.

Further, the filter cartridge 26 is detachable to the filter accommodating portion 31 (the front part of the shaft casing 8). A user can hold the holding portion 30 of the filter cartridge 26, and pull the filter cartridge 26 upward from the filter accommodating portion 31.

The water outlet 35 is a port for discharging water in which the fine dust was captured by the capturer 25. The water outlet 35 is disposed above the anti-ventilation plate 13 such that the water outlet 35 is above the water surface in a state in which the outboard motor 1 is attached to the hull of the ship and the ship moves forward or in reverse. The water outlet 35 is disposed in a side part (for example, a left part) of the shaft casing 8 so that water is less likely to splash during forward movement of the ship. The water outlet 35 is disposed at a position closer to the front on the side part of the shaft casing 8 so that water is less likely to splash during reverse movement of the ship. The water outlet 35 is opened to a lateral side (for example, to a left side, more specifically, to a left-front side). The water outlet 35 penetrates a side wall (left wall) of the shaft casing 8 and is in communication with the second chamber 34 of the filter accommodating portion 31. Further, an inner diameter of the water outlet 35 is the same as the inner diameter of the water intake 22, for example. The water outlet 35 may be disposed at a position above the anti-ventilation plate 13 and closer to the front on a right part of the shaft casing 8.

As shown in FIG. 3, the fine dust capturing device 21 is independent of the cooling system of the outboard motor 1 that cools the internal combustion engine 2 with water. That is, similarly to a well-known outboard motor, the outboard motor 1 has a water-cooled cooling mechanism that takes in water from the sea, lakes, or rivers and supplies the water to a vicinity of the internal combustion engine 2 to cool the internal combustion engine 2. The fine dust capturing device 21 is provided separately from the cooling mechanism.

An operation and usage method of the fine dust capturing device 21 of the outboard motor 1 having such a configuration will be described. The outboard motor 1 is attached, by using the clamp bracket 12, to, for example, a hull of a ship that is landed on the sea and is moored on a shore. The user prepares a filter cartridge 26 equipped with a new filter 27, and inserts the filter cartridge 26 from the cartridge insertion port 32 to an inside of the filter accommodating portion 31. The insertion operation of the filter cartridge 26 can be performed in a state in which the outboard motor 1 is attached to a hull that is landed on the water. Of course, the insertion operation can also be performed in a state in which the outboard motor 1 is attached to a hull that is landed or in a state in which the outboard motor 1 is detached from a hull.

After inserting the filter cartridge 26 into the filter accommodating portion 31, the user starts an operation of the ship. Sea water flows into the water intake 22 while the ship is moving forward in the sea. At this time, the strainer 23 substantially prevents objects larger than the fine dust, such as seaweed and PET bottle lids existing in the sea or on a sea surface, from flowing through the water intake 22. Meanwhile, the fine dust contained in the sea water passes through the strainer 23 and flows in the water intake 22.

The water flowing in from the water intake 22 flows through the supply passage 24 and flows into the first chamber 33 of the filter accommodating portion 31. Then, the water flowing into the first chamber 33 sequentially passes through the first layer 27A and the second layer 27B of the filter 27 and flows into the second chamber 34. When the water sequentially passes through the first layer 27A and the second layer 27B of the filter 27, the fine dust contained in the water is captured by the filter 27. Specifically, the fine dust is pushed by the water flowing in a direction indicated by the arrow K in FIG. 5, enters the coarse first layer 27A, and then adheres to the fine second layer 27B. The fine dust adhering to the second layer 27B is trapped in the second layer 27B or between the first layer 27A and the second layer 27B. As a result, even when water flows into the filter accommodating portion 31 in a direction opposite to that indicated by the arrow K, the fine dust once adhering to the filter 27 can be prevented from being separated from the filter 27.

The water passing through the filter 27 and flowing into the second chamber 34 is discharged from the second chamber 34 to an outside of the filter accommodating portion 31 (outside of the shaft casing 8), that is, to the sea, through the water outlet 35.

When the ship moves forward, sea water flows through the water intake 22 with a strong momentum and moves into the first chamber 33 through the supply passage 24. Then, in a case where the filter 27 is not clogged, the water moving into the first chamber 33 passes through the filter 27 and moves into the second chamber 34 while keeping the momentum, and spouts from the water outlet 35 to the outside of the shaft casing 8. Since the water outlet 35 is disposed in a side part of the shaft casing 8, the water in the second chamber 34 jumps out to a lateral side of the shaft casing 8 through the water outlet 35 and then falls downward. The user on board can visually check the water that jumps out laterally from the water outlet 35 in this way.

When the operation of the ship is repeated for a long period of time, a large amount of fine dust adheres to the filter 27, and the filter 27 is clogged. When the filter 27 is clogged, it is difficult for the water to pass through the filter 27, so that the momentum of the water flowing out from the water outlet 35 decreases. As a result, the water in the second chamber 34 does not spout from the water outlet 35. For example, the water in the second chamber 34 flows down from the water outlet 35 along an outer surface of the side wall of the shaft casing 8. By visually observing the flowing down water, the user can know that the filter 27 is clogged. When the filter 27 is clogged, the user grabs the holding portion 30 of the filter cartridge 26 and pulls out the filter cartridge 26 from the filter accommodating portion 31. Therefore, the captured fine dust is taken out from the outboard motor 1 together with the filter cartridge 26.

As described above, the outboard motor 1 according to the embodiment of the present invention includes the fine dust capturing device 21 including the water intake 22 that is provided in the gear casing 9 and is used for taking in the water around the outboard motor 1, the capturer 25 for capturing the fine dust contained in the water taken in from the water intake 22, and the water outlet 35 for discharging water in which the fine dust was captured by the capturer 25. Therefore, during an operation of a ship to which the outboard motor 1 is attached, the fine dust contained in water of the sea, lakes, rivers, and the like can be retrieved by the fine dust capturing device 21. If the outboard motor 1 of the present embodiment is widespread and used all over the world, retrieving the fine dust diffused in such as the sea, lakes, and rivers of the world can be promoted.

Further, the fine dust capturing device 21 of the outboard motor 1 of the present embodiment is independent of the cooling system (water-cooled cooling device) of the outboard motor 1 that cools the internal combustion engine 2 of the outboard motor 1 with water. Therefore, the fine dust can be retrieved without decreasing the performance of the outboard motor 1 cooling the internal combustion engine 2.

Since the water intake 22 of the fine dust capturing device 21 is disposed below the anti-ventilation plate 13, the water intake 22 can sink in water, and water in such as the sea, lakes, rivers can be reliably taken into the filter accommodating portion 31 from the water intake 22.

Further, since the water intake 22 is opened forward in the front part of the gear casing 9, water that hits the front part of the gear casing 9 easily flows through the water intake 22 when the ship moves forward. Therefore, an amount of water taken into the filter accommodating portion 31 from the water intake 22 can be increased. The water from such as the sea, lakes, and rivers can be sufficiently taken into the filter accommodating portion 31 without using a pump.

Since the water outlet 35 of the fine dust capturing device 21 is disposed above the anti-ventilation plate 13, the water outlet 35 can be above the water surface, and water from such as the sea, lakes, rivers can be prevented from flowing in a reverse direction from the water outlet 35 into the filter accommodating portion 31.

Further, since the water outlet 35 is disposed in the side part of the shaft casing 8, when water from such as the sea, lakes, and rivers hits the front part of the shaft casing 8 during the forward movement of the ship, the water can be prevented from flowing in the reverse direction from the water outlet 35 into the filter accommodating portion 31.

Further, since the water outlet 35 is disposed at a position close to the front on the side part of the shaft casing 8, when water from such as the sea, lakes, and rivers hits the rear part of the shaft casing 8 during the reverse movement of the ship, the water can be prevented from flowing in the reverse direction from the water outlet 35 into the filter accommodating portion 31. Further, since the water outlet 35 is disposed at a position close to the front on the side part of the shaft casing 8, the user can easily visually confirm whether the water spouts from the water outlet 35 during the operation of the ship. Therefore, the user can easily know whether the filter 27 is clogged, and can easily determine whether the filter cartridge 26 is needed to be replaced.

Further, since the capturer 25 of the fine dust capturing device 21 is disposed above the anti-ventilation plate 13, in a state in which the outboard motor 1 is attached to a hull of a ship that is landed on the water, a portion of the outboard motor 1 where the capturer 25 is disposed is above the water surface. Therefore, the user can attach/detach the filter cartridge 26 in a state in which the outboard motor 1 is attached to the hull of the ship that is landed on the water.

The capturer 25 is disposed in front of the drive shaft 4 in the shaft casing 8. Therefore, a position of the capturer 25 (the holding portion 30 of the filter cartridge 26) can be set to a position where the user accesses easily. Further, the capturer 25 can be provided at a position where the capturer 25 does not intersect with the cooling system of the outboard motor 1, and the fine dust capturing device 21 independent of the cooling system can be easily provided.

Further, the capturer 25 includes the filter cartridge 26 that is detachable to the filter accommodating portion 31. Therefore, the user can easily restore and maintain the fine dust capturing performance of the fine dust capturing device 21 by replacing the filter cartridge 26. That is, the workability of maintenance of the fine dust capturing device 21 can be improved.

Further, since the filter 27 has a multi-layer structure, the fine dust can be reliably captured, and the once-captured fine dust can be held by the filter 27.

In the fine dust capturing device 21, a configuration in which the user is notified of a presence or absence of clogging of the filter 27 based on a spouting degree of the water from the water outlet 35 is given as an example, but the following can be adopted as a configuration for notifying the user of the presence or absence of clogging of the filter 27. That is, a bypass passage that bypasses the filter 27 and connects the first chamber 33 and the second chamber 34; a valve that is provided at an entrance of the bypass passage and that opens when a pressure of water trying to flow into the bypass passage exceeds a predetermined value, a sensor that detects the flow of water in the bypass passage; and an alarm device such as an alarm lamp that issues an alarm based on a detection signal from the sensor may be provided in the fine dust capturing device 21.

In the configuration, when the filter 27 is not clogged, the water passes through the filter 27, so that the pressure of the water trying to flow into the bypass passage is equal to or less than the predetermined value. In this case, the valve remains closed and no water flows into the bypass passage. Meanwhile, when the filter 27 is clogged, it is difficult for the water to pass through the filter 27, so that the pressure of water trying to flow into the bypass passage increases. Then, when the pressure of the water exceeds the predetermined value, the valve opens and the water flows into the bypass passage. When the inflow of water into the bypass passage is detected by the sensor, an alarm is issued from the alarm device. The user can know that the filter 27 is clogged based on the alarm.

In the above embodiment, a case in which the capturer 25 of the fine dust capturing device 21 is disposed inside the outboard motor 1 is given as an example, but a capturer 43 may be disposed outside an outboard motor 40, as in a fine dust capturing device 41 of the outboard motor 40 according to another embodiment shown in FIG. 7. Specifically, a water intake 42 is disposed in the front part of the gear casing 9 as in the outboard motor 1. The capturer 43 includes a tank 44 independent of the outboard motor 40 and a filter 45 (or filter cartridge) provided in the tank 44, and the capturer 43 is installed on a hull of a ship to which, for example, the outboard motor 40 is attached. Further, the outboard motor 40 and an inlet of the tank 44 are connected by using a tube 46 such as a hose or a pipe, the water once taken into the shaft casing 8 from the water intake 42 is supplied to the inlet of the tank 44 through the tube 46. Then, the water supplied to the tank 44 passes through the filter 45, and thus the fine dust contained in the water is captured. Further, another hose or pipe or the like is connected to a water outlet 47 of the tank 44, and the water in which the fine dust was captured is discharged from the tank 44 and returned to the sea.

Further, in the ship propulsion machine of the present invention, the power source is not limited to the internal combustion engine, but may be an electric motor. Further, the present invention is not limited to the outboard motor, and can also be applied to an inboard/outboard motor.

In addition to microplastics, the fine dust includes various visible dusts having an outer diameter or a maximum length of 5 mm or less, such as residue of food used for fish farming.

The present invention can be modified as appropriate without departing from the concept or spirit of the invention which can be read from the claims and the entire specification, and the ship propulsion machine to which such a change is applied is also included in the technical concept of the present disclosure.

What is claimed is:

1. A ship propulsion machine that gives a propulsive force to a ship, comprising:

a power source;

a propulsion device that converts power of the power source into a propulsive force of the ship;

a power transmission mechanism that transmits power of the power source to the propulsion device;

a casing that covers the power source and the power transmission mechanism; and a fine dust capturing device, wherein the fine dust capturing device includes:

a water intake which is provided in the casing and through which water around the ship propulsion machine is to be taken in, a capturer that captures fine dust contained in water taken in from the water intake, and a water outlet through which water in which the fine dust was captured by the capturer is to be discharged, and the fine dust capturing device is independent of a cooling system of the ship propulsion machine that cools the power source with water.

2. The ship propulsion machine according to claim 1, further comprising:

an anti-ventilation plate, wherein the water intake is disposed below the anti-ventilation plate.

3. The ship propulsion machine according to claim 2, wherein the water intake is disposed in a front part of the casing, and is opened forward.

4. The ship propulsion machine according to claim 2, wherein the water outlet is disposed in a side part of the casing that is above the anti-ventilation plate.

5. The ship propulsion machine according to claim 2, wherein the capturer is provided above the anti-ventilation plate in the casing, and a supply passage through which water taken in from the water intake is supplied to the capturer is provided in the casing.

6. The ship propulsion machine according to claim 1, wherein the power transmission mechanism includes a drive shaft that extends in an upper-down direction between the power source disposed on an upper part of the ship propulsion machine and the propulsion device disposed on a lower part of the ship propulsion machine, so as to transmit power of the power source to the propulsion device, and the capturer is provided in front of the drive shaft in the casing.

7. A ship propulsion machine that gives a propulsive force to a ship, comprising:

a power source;

a propulsion device that converts power of the power source into a propulsive force of the ship;

a power transmission mechanism that transmits power of the power source to the propulsion device;

a casing that covers the power source and the power transmission mechanism;

a fine dust capturing device; and an anti-ventilation plate, wherein the fine dust capturing device includes:

a water intake which is provided in the casing and through which water around the ship propulsion machine is to be taken in, a capturer that captures fine dust contained in water taken in from the water intake, and a water outlet through which water in which the fine dust was captured by the capturer is to be discharged, the water intake is disposed below the anti-ventilation plate, the capturer is provided above the anti-ventilation plate in the casing, and a supply passage through which water taken in from the water intake is supplied to the capturer is provided in the casing, and the capturer includes a filter cartridge that is detachable to the casing, and the filter cartridge includes a sheet-shaped or plate-shaped filter and a support that supports the filter.

* * * * *